US006348666B2

(12) United States Patent
Rival et al.

(10) Patent No.: US 6,348,666 B2
(45) Date of Patent: Feb. 19, 2002

(54) POLE FOR AN ELECTRICAL CIRCUIT BREAKER, EQUIPPED WITH AN EXTINGUISHING CHAMBER WITH DIELECTRIC SHIELDS

(75) Inventors: Marc Rival, Panissage; Jeremy Dorn, Grenoble; Lucas Pellegrin, Corenc; Laurent Aureyre, Grenoble, all of (FR)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/755,050

(22) Filed: Jan. 8, 2001

(30) Foreign Application Priority Data

Jan. 7, 2000 (FR) ..... 00 00199

(51) Int. Cl.[7] ..... H01H 33/02
(52) U.S. Cl. ..... 218/156; 335/201; 218/15
(58) Field of Search ..... 218/7, 15, 34–37, 218/76–77, 81, 89, 90, 103, 105, 106, 149, 151, 155–6; 200/293–308; 335/201

(56) References Cited

U.S. PATENT DOCUMENTS 2,468,422 A * 4/1949 Wood ..... 218/156
3,441,697 A * 4/1969 Wingard ..... 218/156
4,650,938 A 3/1987 Genba
4,877,929 A 10/1989 Rival
6,248,970 B1 * 6/2001 DiMarco et al. ..... 218/149

FOREIGN PATENT DOCUMENTS

FR 93908 6/1969

* cited by examiner

*Primary Examiner*—Lincoln Donovan
(74) *Attorney, Agent, or Firm*—Parkhurst & Wendel, L.L.P.

(57) ABSTRACT

An electrical circuit breaker pole comprises a stationary contact means, a movable contact means, and an arc extinguishing chamber comprising two side flanges, separators, a front opening situated near to the contact zone of the stationary contact means, a lower arcing horn, an upper arcing horn and a pair of lateral dielectric shields laterally limiting the front opening of the chamber. Each lateral dielectric shield is arranged in such a way as to be interposed laterally between the separators and the movable contact means in the open position. The pair of lateral dielectric shields is arranged in such a way that the width of the opening of the chamber is appreciably smaller near to the upper arcing horn than pear to the lower arcing horn.

5 Claims, 3 Drawing Sheets

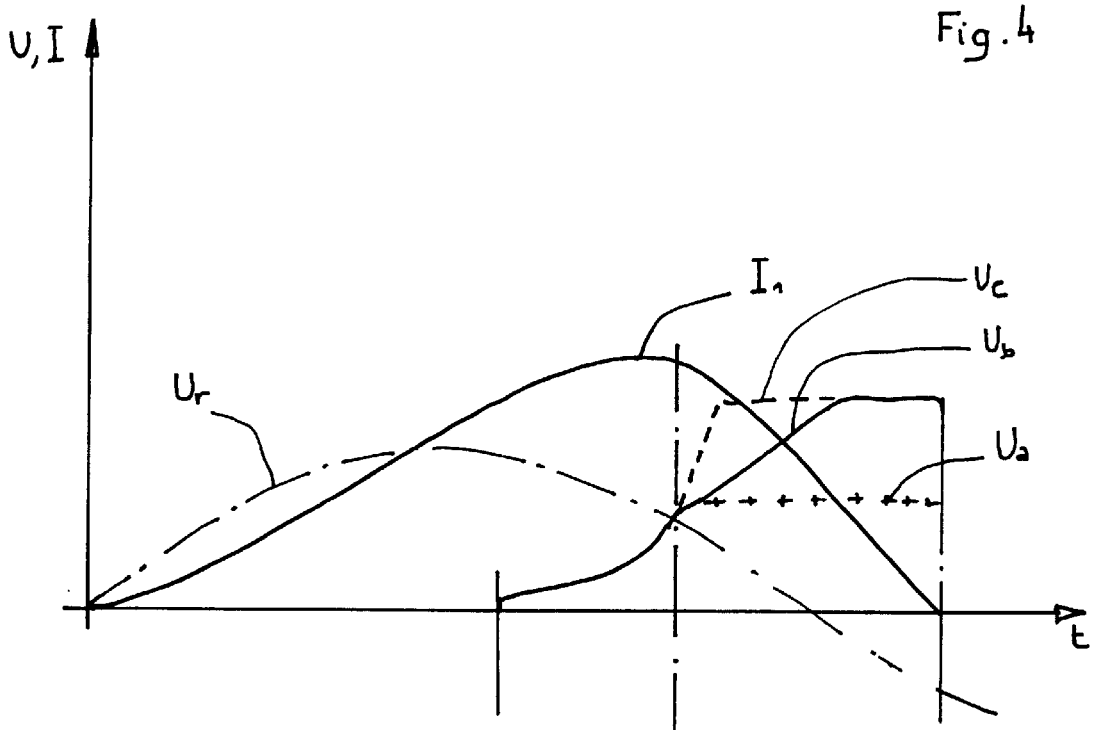
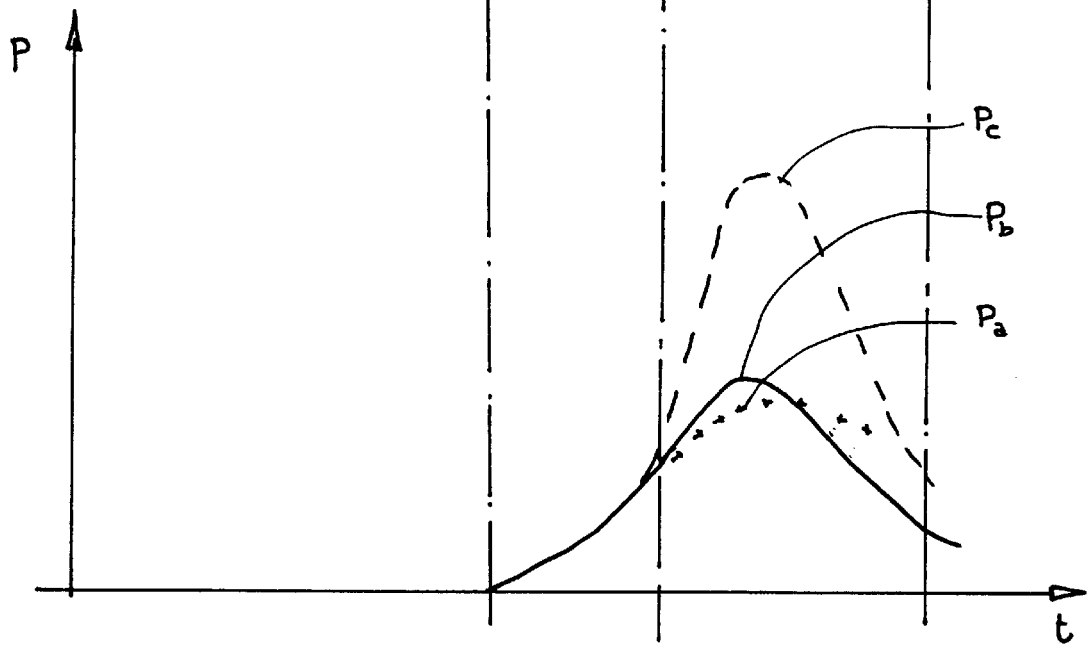
Fig. 5

POLE FOR AN ELECTRICAL CIRCUIT BREAKER, EQUIPPED WITH AN EXTINGUISHING CHAMBER WITH DIELECTRIC SHIELDS

BACKGROUND OF THE INVENTION

The invention relates to an arc extinguishing chamber of a low-voltage, high-current circuit breaker.

The document EP 0,306,382 describes a multipole circuit breaker with a molded insulating case housing an operating mechanism coupled to a switching bar so as to perform opening and closing of all the poles of the circuit breaker. Each pole comprises a stationary contact means, a movable contact means and an arc extinguishing chamber. The stationary contact means comprise a fixed conducting current input strip supported by the back-plate of the case, stationary main contacts and a stationary arcing contact. The stationary contact strip is arranged in front-connection. In other words, it is formed by a relatively straight metal bar which does not impose a curved path on the current flowing through it and consequently prevents any electromagnetic loop effect on the arc arising when opening takes place. The movable contact means comprise a fixed conducting current input strip also supported by the back-plate of the case, and a contact system having a plurality of identical main contacts arranged in two series of the same number on each side of a movable arcing contact extending longitudinally along the center axis of the pole. The arcing contact protrudes out towards the inside of the chamber and enables the arc to enter the chamber. The arc extinguishing chamber is arranged above the first strip and comprises side flanges supporting a stack of separators formed by metal arc deionization plates, each plate having a V-shaped notch. A lower arcing horn and an upper arcing horn are located on each side of the stack of plates of the extinguishing chamber. The upper arcing horn is provided with two side flaps which are folded back in the direction of the stationary contacts and which partially blank off the upper part of the entrance to the chamber. A lateral arc guide cheek is located in the contact separation zone in the extension of each of the two side flanges of the chamber. The two cheeks protrude out from the plane of the corresponding flange obliquely towards one another. The cheeks have an appreciably trapezoid shape and are situated in the bottom part of the chamber, near to the stationary contact. They limit access to the chamber in the bottom part, near to the lower arcing horn. When opening of the contacts takes place, the guide cheeks enable the arc root to be centered along the lower arcing horn.

Such a chamber is particularly well-suited for circuit breakers of high current rating, about 3000 A, having to comply with the requirements of single-phase breaking tests at relatively high voltage, about 600 V, with a fairly low current intensity of about 5 to 10 times the rated current of the circuit breaker. It is on the other hand quite unsuitable for breaking very high fault currents, of about 100 kA, in a moderately high voltage of 480 V. When the breaking current intensity is very high, the diameter of the cross-section of the arc is in fact large, so that the arc forms almost instantaneously on all the contact fingers and immediately occupies the whole of the available volume of the chamber. The chamber is then subjected to a very high pressure and to a very high temperature. The gas-generating emission of the cheeks contributes even further to increasing the pressure. However the positioning of the cheeks and of the upper arcing horn contributes to reducing the opening of the entrance to the chamber, resulting in a delay in balancing of the pressures in the case of the apparatus, which may cause the latter to explode.

An arc extinguishing chamber for a circuit breaker is furthermore known, described in U.S. Pat. No. 4,650,938, comprising separators designed to be arranged near to the contacts, and a pair of side flanges arranged on each side of a longitudinal mid-plane of the chamber to support the separators. Each flange comprises an elongate rib protruding out towards the opposite flange. The two ribs extend over the whole height of the chamber, perpendicularly to the separators, and facing one another. They are arranged between the separators and the contacts so as to restrict the width of the opening of the entrance of the chamber uniformly over the whole height of the chamber. When opening of the contacts takes place, the ribs modify the gas flow in the chamber and protect the part of the flanges supporting the separators from the flow of hot gases. Such an arrangement is useful for a low-performance, bottom-of-the-range circuit breaker in order to prevent the flanges being damaged by the heat of the arc gases. It does not on the other hand enable the whole of the volume of the chamber to be used to cool the gases. The dimensions of the chamber necessary to dissipate the energy of an arc of given power will therefore be very large. In addition, a circuit breaker of this type requires measures to be taken to facilitate entry of the arc into the chamber, and in particular requires the stationary contact to be U-shaped under the bottom surface of the chamber in order to create an electromagnetic loop effect fostering entry of the arc into the chamber.

OBJECT OF THE INVENTION

The object of the invention is therefore to improve the performances of a multipole low-voltage circuit breaker of high rating equipped with an upper arcing horn. Its object is in particular to enable breaking of electric arcs of large diameter generated by very high fault currents in medium voltages, preventing risks of explosion of the chamber.

According to the invention, this objective is achieved by means of a pole for an electrical circuit breaker comprising a case, and an operating mechanism able to switch from a closed position to an open position, said pole comprising:

- a stationary contact means comprising a contact zone,
- a movable contact means able to be coupled to said mechanism and to switch from a closed position in which it is in contact with the contact zone of the stationary contact means to an open position where the two contact means are separated,
- an arc extinguishing chamber comprising:
  - two parallel side flanges made of insulating material situated at equal distance from a longitudinal mid-plane of the chamber,
  - separators extending from one of the side flanges to the other, appreciably perpendicularly to the longitudinal mid-plane,
  - a front opening situated near to the contact zone of the stationary contact means,
  - a lower arcing horn made of conducting material, electrically connected to the stationary contact means,
  - an upper arcing horn made of conducting material, the separators being situated between the lower arcing horn and the upper arcing horn,
  - a pair of lateral dielectric shields made of electrically insulating material protruding out towards the mid-plane and laterally limiting the front opening of the chamber, wherein each lateral dielectric shield is arranged in such a way as to be interposed laterally between the separators and the movable contact means in the open position, the pair of lateral dielectric shields is arranged in such a way that the width of the opening of the chamber measured perpendicularly to the longitudinal mid-plane is appreciably smaller near to the upper arcing horn than near to the lower arcing horn.

The arcing horns contribute to making the arc enter the chamber as soon as the head of the main electric arc switches onto the upper arcing horn, even if the contact strips are of the front-connection type, without any electromagnetic loop effect on the arc. The dielectric shields for their part enable the electric arc to be elongated and curved between the movable contact in the open position and the separators so as to foster switching of the arc onto the upper arcing horn. The narrowing of the dielectric shields in the bottom part of the chamber, near to the stationary contact, enables a wide opening to be obtained for entry to the chamber, which fosters balancing of the pressures between the chamber and the front volume of the pole. A rapid increase of the pressure in the chamber would in fact be adverse to the arc entering the chamber and remaining therein. It would moreover be liable to cause the chamber to explode. The combination of the profiled dielectric shields and the arcing horns favors elongation of the arc in the chamber while controlling the pressure therein.

Preferably, the upper arcing horn comprises a free end situated near to the movable contact means in the open position and interposed between the separators and the movable contact means in the open position. The upper part of each lateral dielectric shield is interposed between the separators and the free end of the upper arcing horn. This positioning of the upper arcing horn enables optimum switching of the arc onto the upper arcing horn to be achieved. The dielectric shields form an obstacle for the arc. The arc has to go round the shields to reach the separators, which elongates the arc.

According to one embodiment, the lateral dielectric shields are made of a material generating little or no gas, in particular a polytetrafluorethylene or a strongly charged 6-6 or 4-6 polyamide. The screens therefore do not contribute to increasing the pressures in the chamber. In addition, they do not generate any gas flow liable to hinder entry of the arc into the chamber.

According to one embodiment, each dielectric shield comprises an upper part and a lower part appreciably narrower than the upper part. Alternatively, the lower part can be totally eliminated.

According to one embodiment, each dielectric shield comprises a front part, the front parts of the two dielectric shields laterally bounding the contact zone at least partially. The front parts of the shields acts as a protective screen for the side wall of the pole.

BRIEF DESCRIPTION OF THE DRAWINGS

Other advantages and features of the invention will become more clearly apparent from the following description of an embodiment of the invention given as a non-restrictive example only and represented in the accompanying drawings in which:

FIG. 4 represents the curves of the variations of the current intensity and arc voltage versus time for a circuit breaker according to the invention and for two other circuit breakers, for comparative purposes;

FIG. 5 represents the curves of the pressure variations versus time for a circuit breaker according to the invention and for two other circuit breakers, for comparative purposes.

DETAILED DESCRIPTION OF THE PREFERRED EMBODIMENT

Figure 1:
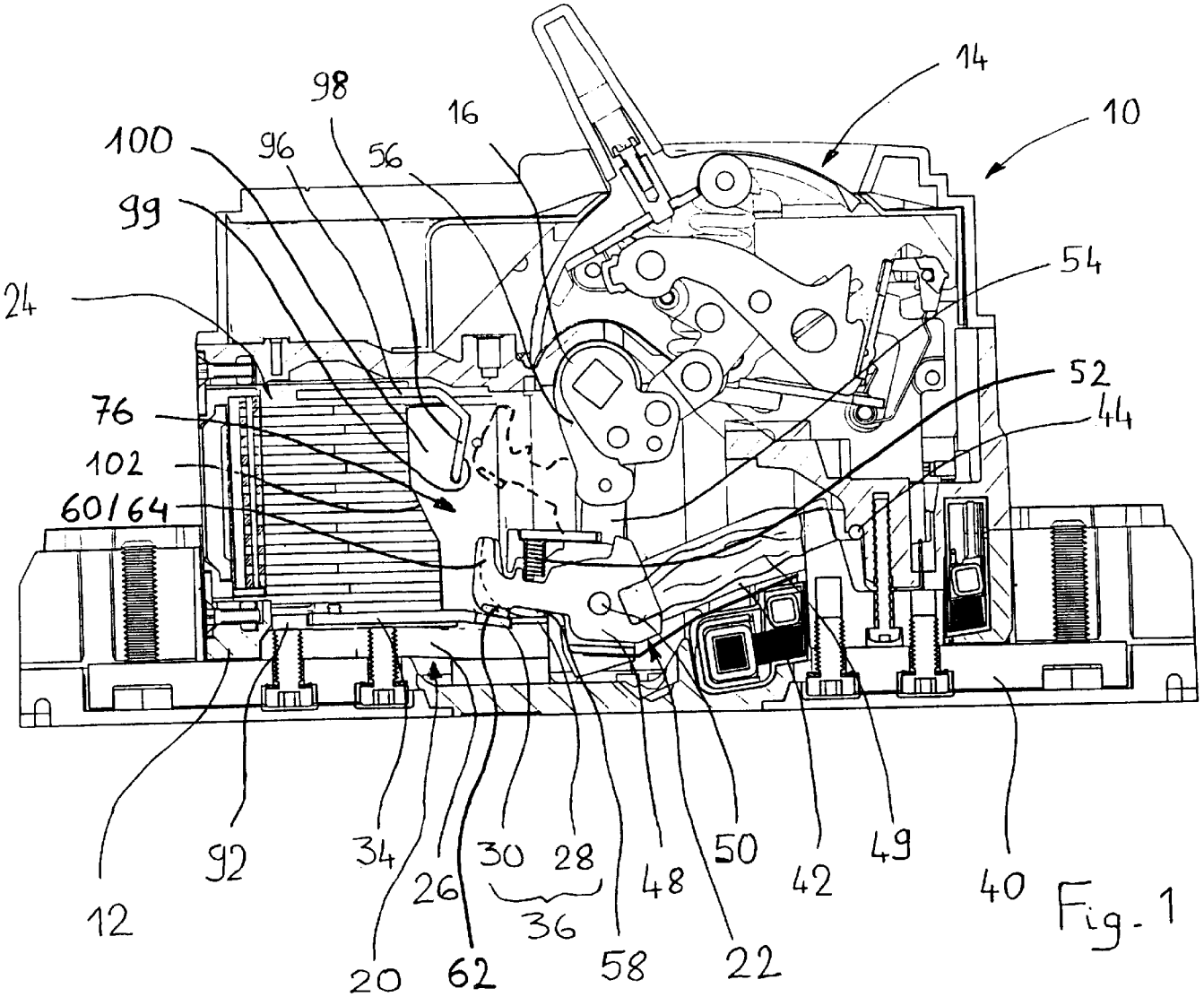
FIG. 1 represents a view of a pole of a switchgear apparatus according to a preferred embodiment of the invention, in cross-section along a longitudinal mid-plane of an arc extinguishing chamber of this pole.
Figure 2:
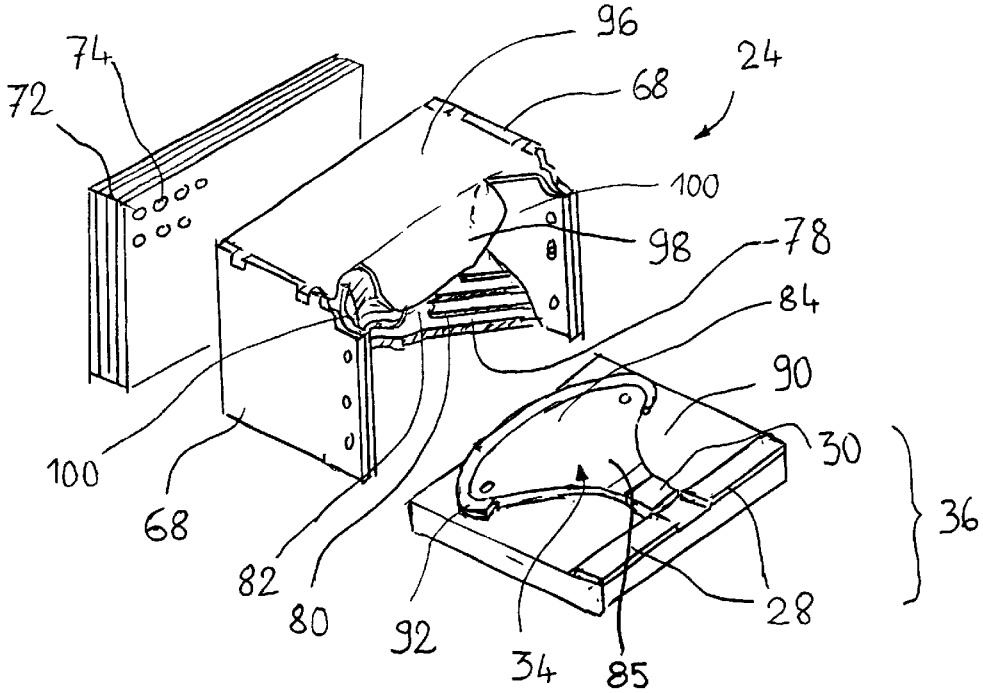
FIG. 2 represents an exploded perspective view of a part of the pole of FIG. 1, showing in particular the arc extinguishing chamber.
Figure 3:
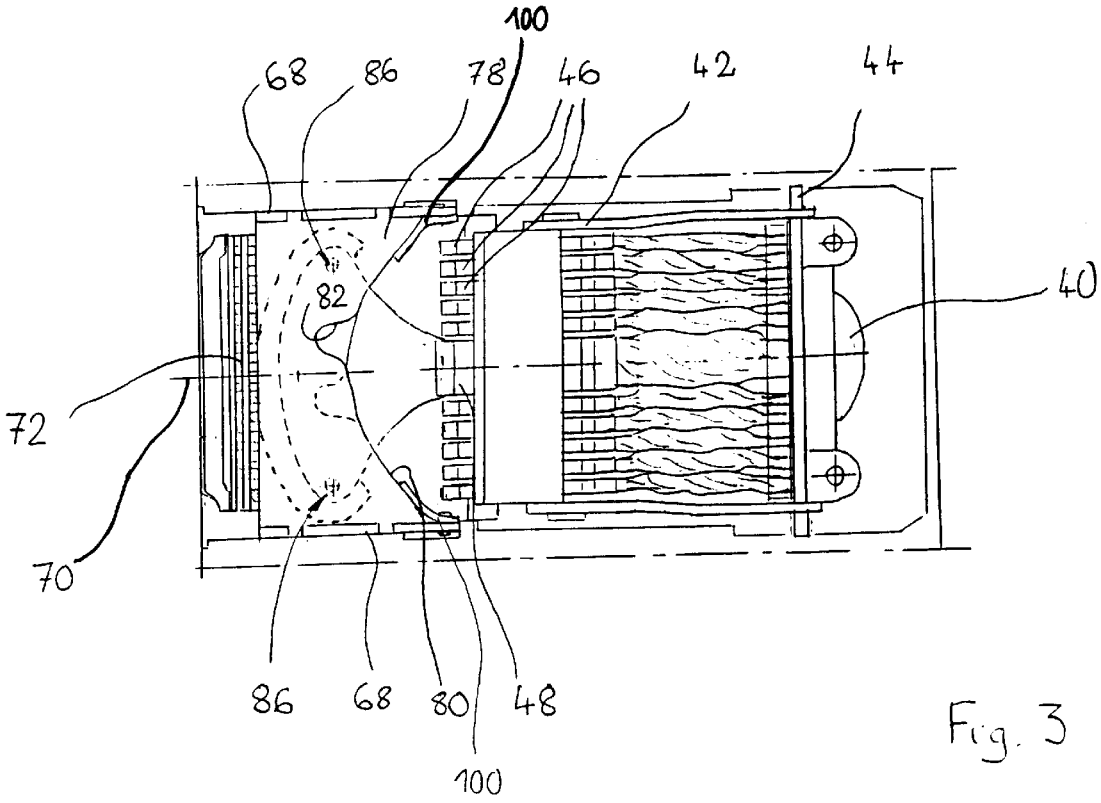
FIG. 3 represents a top view of the pole of FIG. 1.

With reference to FIGS. 1 to 3, a low-voltage multipole power circuit breaker 10 comprises an insulating case 12 housing an operating mechanism 14 of known type, equipped with a transverse switching bar 16 common to all the poles, turning in bearings arranged in the case 12. Each pole comprises a stationary contact means 20, a movable contact means 22 and an arc extinguishing chamber 24 situated near to the stationary contact means 20.

The stationary contact means 20 comprise a current input strip 26 mounted at the back of the case 12, partly under the arc extinguishing chamber 24. The stationary contact means 20 comprise in addition two main contact blocks 28 (FIG. 2) fixed directly to the current input strip 26 and a central arcing contact 30 which is arranged on a metal plate 32 protruding out with respect to the fixed contact blocks 28. The metal plate 32 is fixed to the current input strip 26 in an intermediate zone between the blocks 28 and the chamber 24. It is extended towards the inside of the chamber 24 by a conducting lower arcing horn 34. The current input strip 26, blocks 28, arcing contact 30 and arcing horn 34 are made of various metallic conducting materials and are at the same potential. The arcing contact 30 and blocks 28 together form a contact zone 36 designed to perform the electrical contact with the movable contact means 22.

The movable contact means 22 comprise for their part a fixed conducting current input strip 40, a support cage 42 pivotally mounted around an axis 44 fixed with respect to the case 12, and a plurality of main contact fingers 46 (FIG. 3) placed on each side of a central arcing contact finger 48. The contact fingers 46, 48 pivot around a common geometric axis 50, fixed with respect to the cage 42, and are biased towards the stationary contact means by contact pressure springs 52. A connecting rod 54 performs the coupling between the cage 42 of the movable contact means 22 and a crank 56 of the switching bar 16 of the mechanism 14. Each main finger 46 comprises a contact pad 58 designed to perform the contact with the corresponding contact block 28 of the stationary contact means 20 when the apparatus is in the closed position represented in FIG. 1, and a spigot 60 protruding out beyond the contact pad in the direction of the arc extinguishing chamber 24. The arcing contact finger for its part has a movable arcing contact 62 designed to perform contact with the stationary arcing contact 30 of the stationary contact means 20 when the apparatus is in the closed position represented in FIG. 1, and a spigot 64 protruding out beyond the contact pad in the direction of the arc extinguishing chamber 24 with an identical shape to that of the spigots 60. The contact fingers 46, 48 are electrically connected to the current input strip 40 by means of braids 49.

The arc extinguishing chamber 24 comprises two side flanges 68 made of insulating material, which are parallel to the cross-sectional plane of FIG. 1 and situated at equal distance on each side of the latter, so that the cross-sectional plane constitutes a geometric longitudinal mid-plane 70 of the chamber 24 and of the pole. A rear wall 72 for outlet of the gases is arranged at the rear of the chamber, perpendicularly to the side flanges 68. This wall 72 comprises one or more orifices 74 for outlet of the breaking gases. A front opening 76 is arranged near to the contact zone 36, opposite from the rear wall 72. Separators 78 formed by flat metal plates extend perpendicularly to the longitudinal mid-plane 70 from the front opening 76 to the rear wall 72. The separators 78 are arranged at a distance from one another so as to leave the possibility of a gas flow between the front opening 76 and the rear wall 72. They are supported laterally by the side flanges 68. Each plate 78 has an front electric arc pick-up edge 80 which presents a curved concave U-shape or V-shape approximately in the plane of the plate, with a narrower dissymmetric notch 82. The separators 78 are stacked so that the notches 82 are alternately on one and the other lateral side of the chamber 24.

The lower arcing horn 34, designed to receive the arc root when the arc extends from the stationary arcing contact 30 towards the inside of the chamber 24, comprises a rear part 84 situated inside the chamber, and an intermediate part 85 joining the rear part to the stationary arcing contact 30. The width of the rear part 84, i.e. its largest dimension measured along an axis perpendicular to the longitudinal mid-plane 70 of the chamber, is large whereas the intermediate part 85 constitutes a narrower section. The rear part 84 presents two lateral surfaces constituting receiving areas 86 for the root of an electric arc developing in the chamber 24.

The lower arcing horn 34 is fixed to a back-plate 90 made of insulating material, in this instance 6-6 polyamide 30% charged with glass fiber. The part of the plate 90 not covered by the arcing horn extends up to the flanges 68 and the rear wall 72. It presents a periphery 92 forming a shoulder protruding out into the chamber and coming flush with the periphery of the rear part 84 of the arcing horn.

An upper arcing horn 96, designed to receive the head of the arc when it leaves the arcing contact finger 48, is formed by a metal plate perpendicular to the longitudinal mid-plane 70, supported by the side flanges. The upper arcing horn 96 is appreciably parallel to the separators 78 in its rear part and comprises in its front part a flap 98 which partially closes the upper part of the chamber, and which is interposed between the front edges of the separators 78 situated in the upper part of the chamber and the outside of the chamber. The flap 98 comprises a face 99 which, when the movable contact means are in the open position (in broken line in FIG. 1), is situated in immediate proximity to the spigots 60, 64 of the contact fingers 46, 48.

Two lateral dielectric shields 100, placed symmetrically with respect to the longitudinal mid-plane, limit the front opening of the chamber. The dielectric shields 100 are formed by a plate made of insulating material generating little or no gas, preferably polytetrafluorethylene (PTFE) or strongly charged 6-6 or 4-6 polyamide, or a thermosetting material or a polyester. Each dielectric shield comprises a flat front part situated in the extension of the side walls of the chamber outside the latter, and a rear part which curves towards the chamber and towards the mid-plane and follows the outline of the separators exactly. The front parts of the two dielectric shields 100 form cheeks situated on each side of the stationary contact strips and extending over a sufficient height for the contact pads 58 to also be situated between the cheeks when the circuit breaker is open. The rear part of each dielectric shield itself comprises an upper part extending fairly deeply towards the chamber, and a smaller lower part. The edge 102 of the dielectric shields 100 facing the chamber 24 is oblique and forms a notch at the entrance 76 of the chamber. In other words, the dielectric shields 100 only reduce the width of the opening 76 of the chamber slightly in the bottom part thereof near to the stationary contact means, and reduce the width of the front opening 76 of the chamber to a greater extent in the top part thereof near to the upper arcing horn 96. The upper part of the rear part of the dielectric shields 100 is inserted between the flap 98 of the upper arcing horn 96 and the separators 78 situated in the upper part of the chamber.

Operation of the Device is as Follows

In the closed position, the switching bar 16 is locked by the mechanism 14 and holds the cage 42 in the position illustrated in FIG. 1. The springs 52 provide a contact pressure between the pads 58 of the main contact fingers 46 and the contact strips 28, and also between the contact 62 of the arcing contact finger 48 and the stationary arcing contact 30.

In the presence of a fault current of very high intensity, above 100 kA peak, a trip device causes the mechanism 14 to be released resulting in opening. Rotation of the switching shaft 16 makes the cage 42 pivot around its rotational axis 44. The main contact fingers 46 pivot very slightly around the rotational axis 50, counterclockwise in FIG. 1, due to the effect of the contact pressure springs 52, while remaining in contact with the blocks 28. They then come up against a stop of the cage 42 and are driven fixedly with the cage 42 in clockwise rotation around the rotational axis 44 so that they separate from the blocks 28. As far as the principle is concerned, the movement of the arcing contact finger 48 is similar, but staggered in time due to the spatial offset between the blocks 28 and the stationary arcing contact 30. Thus, when separation of the main contact fingers 46 takes place, the arcing contact finger 48 is still in contact with the stationary arcing contact 30. The whole of the current flowing between the strips 26, 40 then flows via the arcing contacts 30, 62. In a second phase, the arcing contact finger 48 in turn comes up against a stop of the cage 42 which drives it fixedly with the cage 42 in the clockwise rotational movement of the latter around the rotational axis 44 of the cage, so that separation of the arcing contact finger 48 and of the stationary arcing contact 30 takes place. An arc then forms, not only between the arcing contacts 30, but also between the contact fingers 46 and the strips 28, as the current intensity is such that the surface of the arcing contacts is insufficient to receive the arc. It should simply be borne in mind for indication purposes that a free arc has an intensity of $10^4$ Amps peak per sq.cm of arc cross-section.

When the mechanism reaches the open position, the contact fingers 46, 48 are located near to the flap 98 of the upper arcing horn, in the position represented in a broken line in FIG. 1. The arc head then switches onto the upper arcing horn 96 enabling a main arc to be drawn between the upper and lower arcing horns, whereas secondary arcs form in series with the main arc between the face 99 of the flap 98 and the spigots 60, 64 of the contact fingers 46, 48. The upper part of the dielectric shields forces the arc to take a bypass path so that the head of the main arc migrates progressively onto the upper arcing horn towards the back of the chamber.

The arc, on entering the chamber 24, divides more or less on contact with the separators 78 into elemental arcs, each elemental arc forming an electrical serial connection between two adjacent separators 78 or between each arcing horn 34, 96 and the facing separator 78.

The pressure increase in the chamber is not too high due in particular to the large width of the bottom part of the chamber entrance, which enables balancing of the pressures in the pole as a whole to be achieved. The choice of a material generating little or no gas to constitute the dielectric shields also contributes to the pressure in the chamber not being increased.

Comparative tests were carried out with a front-connection circuit breaker comprising arcing horns but no dielectric shields (curves "a"), a circuit breaker comprising arcing horns and dielectric shields imposing a uniform restriction of the width of the chamber entrance from top to bottom of the opening (curve "b") and a circuit breaker according to the invention (curve "c"). FIGS. 4 and 5 respectively represent the variations of the voltages and pressures on opening on a fault current of very high intensity. The curve $U_R$ represents the power system voltage.

When no dielectric shields are present (curves "a"), the arc remains oblique to the entrance of the chamber, between the flap of the upper arcing horn and the lower arcing horn. The separators situated in the upper part of the chamber are totally unused. The pressure $P_A$ in the chamber is low. The arc voltage $U_A$ is not high enough to prevent restriking of the arc after the current has passed zero. Breaking has failed to be performed successfully.

When the dielectric shields uniformly blank off the lateral sides of the entrance to the chamber (curves "b"), the pressure $P_B$ in the chamber increases very quickly until it reaches an extreme value linked to the product UI. This very high pressure value is explained in particular by ablation of the material in the bottom zone of the chamber. The voltage $U_B$ increases very early in the chamber and remains at a high value. When the current passes zero, the arc voltage $U_B$ is sufficiently high to prevent its regeneration. The current is interrupted. However, the maximum pressure reached in the chamber requires a considerable strengthening of the walls of the chamber to prevent the apparatus from exploding. In addition, the early increase of the arc voltage $U_B$ is of no use for a moderately limiting apparatus, since the essential thing is to have a sufficiently high arc voltage at the time the current passes zero.

When a circuit breaker according to the invention is used (curves "c"), the pressure $P_C$ increases as quickly but stabilizes earlier at a less high value than before. The arc voltage $U_C$ increases less quickly and reaches its maximum value when the limited current has already started to decrease. However, the maximum value is identical to that of the previous test and remains at this level until the current passes zero, so that at this moment the arc is definitively extinguished.

Naturally, various modifications are possible without departing from the scope of the invention. In the embodiment described, the dielectric shields generate little or no gas, so as to control the pressure increase in the chamber. However, it may be useful in certain configurations to provide dielectric shields made of gas-generating material. There is on this point a compromise to be made between the final breaking capacity of the circuit breaker and its performances in the other breaking tests, in particular in tests at high voltage and low current.

The flap 98 of the upper arcing horn, which fosters switching of the arc, can be omitted if the position reached by the movable contact fingers at the end of opening is favorable to direct switching onto the upper arcing horn;

In the previously described embodiment, the shields have a front part which acts as a screen between the contact zone where the electric arc arises and the side walls of the pole situated on each side of the contact zone. This front part can be omitted if required, if the side walls of the pole situated on each side of the contact zone have a sufficient resistance to the arc.

To obtain the effect sought for when breaking very high currents at low voltage, the existence of specific arcing contacts penetrating more deeply into the chamber than the main contacts is not necessary. This architecture is chosen to achieve other performances of the apparatus, in particular when subjected to tests at high voltage and low current. The invention moreover also applies to an apparatus wherein the movable contact means only comprise a contact finger.

What is claimed is:

1. A pole for an electrical circuit breaker comprising a case, and an operating mechanism able to switch from a closed position to an open position, said pole comprising:

a stationary contact means comprising a contact zone, a movable contact means able to be coupled to said mechanism and to switch from a closed position in which it is in contact with the contact zone of the stationary contact means to an open position where the two contact means are separated, an arc extinguishing chamber comprising:

two parallel side flanges made of insulating material situated at equal distance from a longitudinal mid-plane of the chamber, separators extending from one of the side flanges to the other, appreciably perpendicularly to the longitudinal mid-plane, a front opening situated near to the contact zone of the stationary contact means, a lower arcing horn made of conducting material, electrically connected to the stationary contact means, an upper arcing horn made of conducting material, the separators being situated between the lower arcing horn and the upper arcing horn, a pair of lateral dielectric shields made of electrically insulating material protruding out towards the mid-plane and laterally limiting the front opening of the chamber, wherein each lateral dielectric shield is arranged in such a way as to be interposed laterally between the separators and the movable contact means in the open position, the pair of lateral dielectric shields is arranged in such a way that the width of the opening of the chamber measured perpendicularly to the longitudinal mid-plane is appreciably smaller near to the upper arcing horn than near to the lower arcing horn.

2. The pole according to claim 1, wherein the upper arcing horn comprises a free end situated near to the movable contact means in the open position and interposed between the separators and the movable contact means in the open position, the upper part of each lateral dielectric shield is interposed between the separators and the free end of the upper arcing horn.

3. The pole according to claim 1, wherein the lateral dielectric shields are made of a material generating little or no gas, in particular a polytetrafluorethylene or a strongly charged 6-6 or 6 polyamide.

4. The pole according to claim 1, wherein each lateral dielectric shield comprises an upper part and a lower part appreciably narrower than the upper part.

5. The pole according to claim 1, wherein each dielectric shield comprises a front part, the front parts of the two dielectric shields laterally bounding the contact zone at least partially.

* * * * *